US012715564B2

(12) United States Patent
Kuhlmann

(10) Patent No.: US 12,715,564 B2
(45) Date of Patent: Aug. 25, 2026

(54) ENERGY-SAVING ARRANGEMENT FOR TWIN-SCREW SHIPS

(71) Applicant: Becker Marine Systems GmbH, Hamburg (DE)

(72) Inventor: Henning Kuhlmann, Hamburg (DE)

(73) Assignee: Becker Marine Systems GmbH, Hamburg (DE)

( * ) Notice: Subject to any disclaimer, the term of this patent is extended or adjusted under 35 U.S.C. 154(b) by 351 days.

(21) Appl. No.: 18/277,004

(22) PCT Filed: Feb. 22, 2022

(86) PCT No.: PCT/EP2022/054337
§ 371 (c)(1),
(2) Date: Aug. 11, 2023

(87) PCT Pub. No.: WO2022/180008
PCT Pub. Date: Sep. 1, 2022

(65) Prior Publication Data

US 2024/0400180 A1 Dec. 5, 2024

(30) Foreign Application Priority Data

Feb. 24, 2021 (DE) ..... 202021100922.5

(51) Int. Cl.
*B63H 5/15* (2006.01)
*B63H 5/10* (2006.01)

(52) U.S. Cl.
CPC ..... *B63H 5/15* (2013.01); *B63H 5/10* (2013.01)

(58) Field of Classification Search
CPC ..... B63H 5/15; B63H 5/10
See application file for complete search history.

(56) References Cited

U.S. PATENT DOCUMENTS 3,996,877 A * 12/1976 Schneekluth ..... B63H 1/28 440/79
8,403,716 B2 3/2013 Sakamoto
9,789,943 B2 * 10/2017 Lehmann ..... B63B 3/42

FOREIGN PATENT DOCUMENTS

JP 60-169094 11/1985
JP 2015-116850 6/2015

* cited by examiner

*Primary Examiner* — Stephen P Avila
(74) *Attorney, Agent, or Firm* — KELLY & KELLEY, PLLC

(57) ABSTRACT

In order to create an improved arrangement to reduce the propulsion-power requirement of a twin-screw ship comprising a first propeller and a second propeller and a first guiding device and a second guiding device, wherein, in the forward direction of the watercraft, the first guiding device is arranged in front of the first propeller, and the second guiding device is arranged in front of the second propeller, wherein the first propeller and the second propeller are attached to a first propeller shaft and to a second propeller shaft, and wherein the first propeller shaft defines a first propeller axis and the second propeller shaft defines a second propeller axis, the first guiding device and the second guiding device each comprise at least one fin, which extends from the propeller axes, wherein the fin of the first guiding device and of the second guiding device extend outwardly to the sides of the watercraft respectively.

11 Claims, 4 Drawing Sheets

ENERGY-SAVING ARRANGEMENT FOR TWIN-SCREW SHIPS

Figure 1:
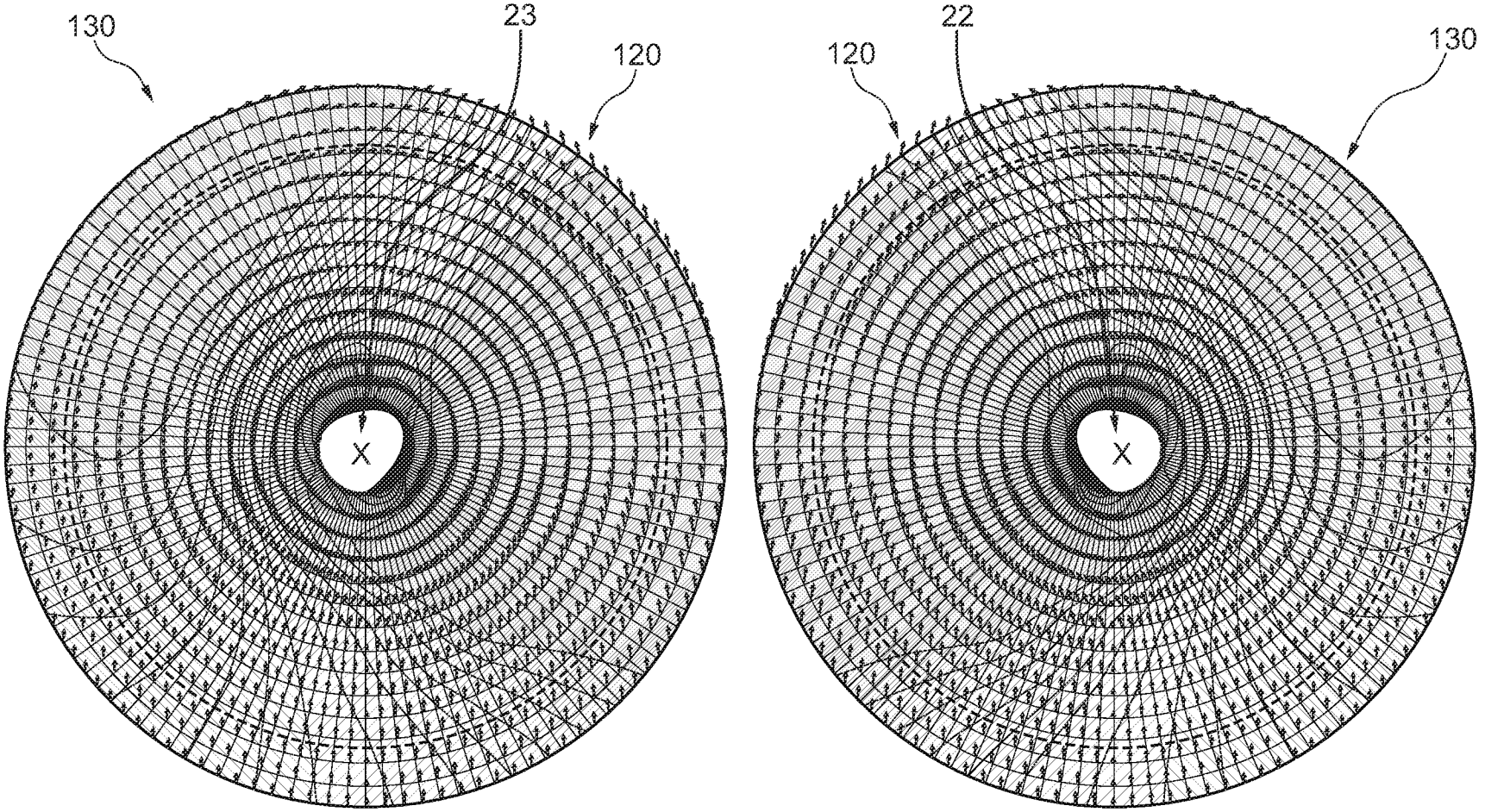

The invention relates to an arrangement for reducing the propulsion-power requirement of a twin-screw ship, comprising a first propeller and a second propeller and comprising a first guiding device and a second guiding device, wherein, viewed in the forward direction of travel of the watercraft, the first guiding device is arranged in front of the first propeller, and the second guiding device is arranged in front of the second propeller. Furthermore, the invention relates to a watercraft, in particular a twin-screw ship, comprising such an arrangement.

Different devices for reducing the propulsion-power requirement of a watercraft are already known. For example, a ring nozzle upstream of the propeller in the direction of travel of the watercraft can optimize an inflow of the propeller, thereby having a positive effect on the energy consumption of the watercraft.

Furthermore, active devices are known to reduce friction losses or swirl losses between the water and the hull. Such devices can create air bubbles via nozzles, which are distributed along the hull and reduce the friction of the hull, allowing additional energy savings.

In ships with asymmetrical skegs or sterns, such as twin-screw ships for example, the asymmetry of the skeg already generates a pre-swirl of an inflow of the propellers in some areas. However, the pre-swirl is not evenly formed in front of the propeller, which is arranged in the flow direction behind the skeg, which means that inflow can take place that is not optimal for the propeller. However, the already known solutions for reducing the drive power requirement cannot be used for a targeted optimization of the pre-swirl.

The object of the invention is to create an improved arrangement for reducing the propulsion-power requirement or for reducing the power consumption of twin-screw ships.

In accordance with one aspect of the invention, an arrangement is provided to reduce the propulsion-power requirement of a twin-screw vessel.

The arrangement comprises a first propeller and a second propeller. Furthermore, the arrangement comprises a first guiding device and a second guiding device, wherein, when viewed in the forward direction of travel of the watercraft, the first guiding device is arranged in front of the first propeller, and the second guiding device is arranged in front of the second propeller.

The first propeller and the second propeller are attached to a first propeller shaft and to a second propeller shaft, wherein the first propeller shaft defines a first propeller axis, and the second propeller shaft defines a second propeller axis.

According to the invention, the first guiding device and the second guiding device each comprise at least one fin, which extends from the propeller axes, wherein the fin of the first guiding device and of the second guiding device extends outwardly towards the sides of the watercraft.

In particular, at least one fin of the first guiding device and of the second guiding device is arranged in an area with reduced pre-swirl.

Furthermore, at least one fin can extend radially or substantially radially from the propeller axes, for example.

The fin of the first guiding device extends towards a first side of the watercraft, while the fin of the second guiding device extends towards a second side of the watercraft, in particular, towards a side opposite to the first side of the watercraft. In particular, the fin of the first guiding device can extend towards the starboard side and the fin of the second guiding device can extend towards the port side, wherein no fins of the two guiding devices extend inwardly, i.e., into an area between the propellers. Therefore, no fins are provided in the inner area between the propellers.

It is provided to arrange the guiding devices on the outside, particularly on the lateral skegs, when the directions of rotation of the propellers are directed inwardly. As a result, the guiding devices of the arrangement are arranged on the impinging sides of the propellers, at which there is a reduced or non-existent pre-swirl.

In the remaining areas of the inflow of the propellers, the asymmetry of the skegs around the propellers already generates a pre-swirl. The two guiding devices can therefore only be arranged in areas of the inflow where there is no pre-swirl. By using the guiding devices, and section-by-section pre-swirl can be generated during inflow of the propellers This results in an inflow of the propellers, which is essentially completely impinged by a pre-swirl.

The targeted or area-by-area generation of the pre-swirl in areas of the water masses flowing to the propellers reduces flow losses. There is an interaction between the water flow and the guiding devices in designated areas, which are determined by the shape of the skegs.

Such areas, which require the use of guiding devices, can be determined with the help of a flow simulation in the direction of travel of the watercraft in front of the propellers. In particular, such a flow simulation can be a CFD (Computational Fluid Dynamics) flow simulation.

Preferably, the first guiding device and the second guiding device each comprise at least two fins.

In an favourable embodiment, the at least two fins of the first guiding device and of the second guiding device are at an angle to each other, wherein the at least two fins of the guiding devices are attached in the area of shaft bearings, in particular, towards the outer shell of the stern tubes, which are designed to support the first and second propeller shafts of the watercraft, or towards a watercraft hull in the area of stern-posts. The angle between the two fins of the respective guiding device can be defined as the rotational axis of the fins starting from the shaft bearing.

The angle between two fins or a plurality of angles between at least three fins of the guiding device can be selected in such a way that the fins span an area with reduced pre-swirl and thus optimally apply a pre-swirl to the corresponding water flow before said water flow hits a propeller.

The angles between the at least three fins can be selected to be identical or different, such that a defined pre-swirl distribution can be generated for the inflow of the propellers. The pre-swirl distribution can generate a pre-swirl that varies along a cross-sectional area of the water masses flowing into the propellers.

According to a further embodiment, at least one fin of the guiding devices is designed to generate a pre-swirl during an inflow of the first and second propellers, wherein the pre-swirl is generated by the respective guiding device in an inflow area of the propeller which has no, or a reduced pre-swirl generated by at least one asymmetrical skeg or stern. This measure results in a uniform or more uniform inflow of the propellers along the entire cross-sectional area as inflow occurs.

The targeted influence of the water masses by the guiding devices minimizes swirl losses and thus results in a saving in the power requirements of the watercraft.

The inflow of the propellers can be precisely adjusted if the fin has a length that corresponds to 65% to 110% a propeller radius of the propellers, preferably 80% to 110%, being particularly preferred, 90% to 105%, and being mostly preferred, 100% thereof. In particular, this can reduce the resistance introduced by the guiding devices in addition to the ship's hull.

If at least two fins per guiding device are provided, the fins of the guiding devices can be structurally reinforced, in particular, if the at least two fins of the first and of the second guiding devices are connected by a connecting bar.

In addition, the at least one connecting bar, which can run, for example, in the form of a ring segment or a straight connection between the at least two fins, can additionally influence the flow of the propellers. This can be achieved by profiling and/or distortion or twisting the connecting bar.

The connecting bar can support the fins particularly efficiently if it is preferably between 30% and 70% of the length of the fins when viewed along a length of the fins, being particularly preferred, between 45% and 55% of the length of the fins or centrally arranged. A single connecting bar can couple or connect a plurality of fins, such as three or more fins for example.

In addition, or as an alternative, the connecting bar can connect the tips of two fins together or mechanically connect a tip of a first fin to a second fin.

Alternatively, a plurality of connecting bars can be provided, which are respectively positioned between two fins. A plurality of connecting bars can form a row, which mechanically couple or connect all fins of a guiding device with each other.

Preferably, at least one connecting bar can create a statically fixed or rigid connection between at least two fins.

In accordance with another exemplary embodiment, the connecting bar has straight or curved shape along a length and/or width of the connecting bar. At least one connecting bar can comprise an bearing-surface profile through which the inflow or water flow can be specifically influenced.

Alternatively, the at least one connecting bar can have a profile to minimize its drag with respect to the inflow of the propellers.

The arrangement and the guiding devices can be technically particularly simple if each of the guiding devices comprises exactly two fins.

Alternatively, each of the guiding devices can comprise exactly three fins.

Alternatively, each of the guiding devices can comprise exactly one fin.

According to a further embodiment, the propellers are designed as counter-rotating propellers, wherein the first guiding device is arranged on an impinging side of the first propeller, and the second guiding device is arranged on an impinging side of the second propeller. Due to an asymmetrical shape of the skegs, areas of the inflow or the incoming water with a reduced pre-swirl are formed on the impinging sides of the propellers, which can be amplified by the guiding devices.

In particular, the two propellers are designed to rotate inwardly at the top, i.e., in the direction of an area between the propellers of the watercraft when the fins of the two guiding devices project outwardly towards the sides of the watercraft.

The terms "turning inwardly" and "turning outwardly" respectively refer to the direction of rotation of the propeller when considering a point in the upper part of the propeller (i.e., a 12 o'clock position) in relation to the state of the propeller installed onto the watercraft. When the propeller rotates outwardly, the movement of the propeller at the upper point of rotation is therefore directed outwardly towards the outside of the watercraft. If the propeller rotates inwardly, the movement of the propeller at the upper point of rotation is directed inwardly in the direction of an area between the two propellers.

The guiding devices can be positioned particularly efficiently on the watercraft if they are positioned essentially mirror-symmetrical with respect to each other with respect to a vertical plane of symmetry of the watercraft. As a result, the straight-line stability of the watercraft can remain unimpaired by the guiding devices.

The inflow of the propellers through the water can be controlled particularly precisely with the help of the guiding devices and the corresponding fins if the fins have a constant or changing profiling and/or position along their length.

In accordance with another aspect of the invention, a watercraft, in particular, a twin-screw ship, is provided. The watercraft has an arrangement according to the invention with a first guiding device and a second guiding device. The two guiding devices are preferably attached to the shaft bearings of the propeller axes and extend in the direction of the sides of the watercraft. In particular, the first guiding device can extend to a first or right side of the watercraft, and the second guiding device can extend to a second or left side of the watercraft.

Figure 2A:
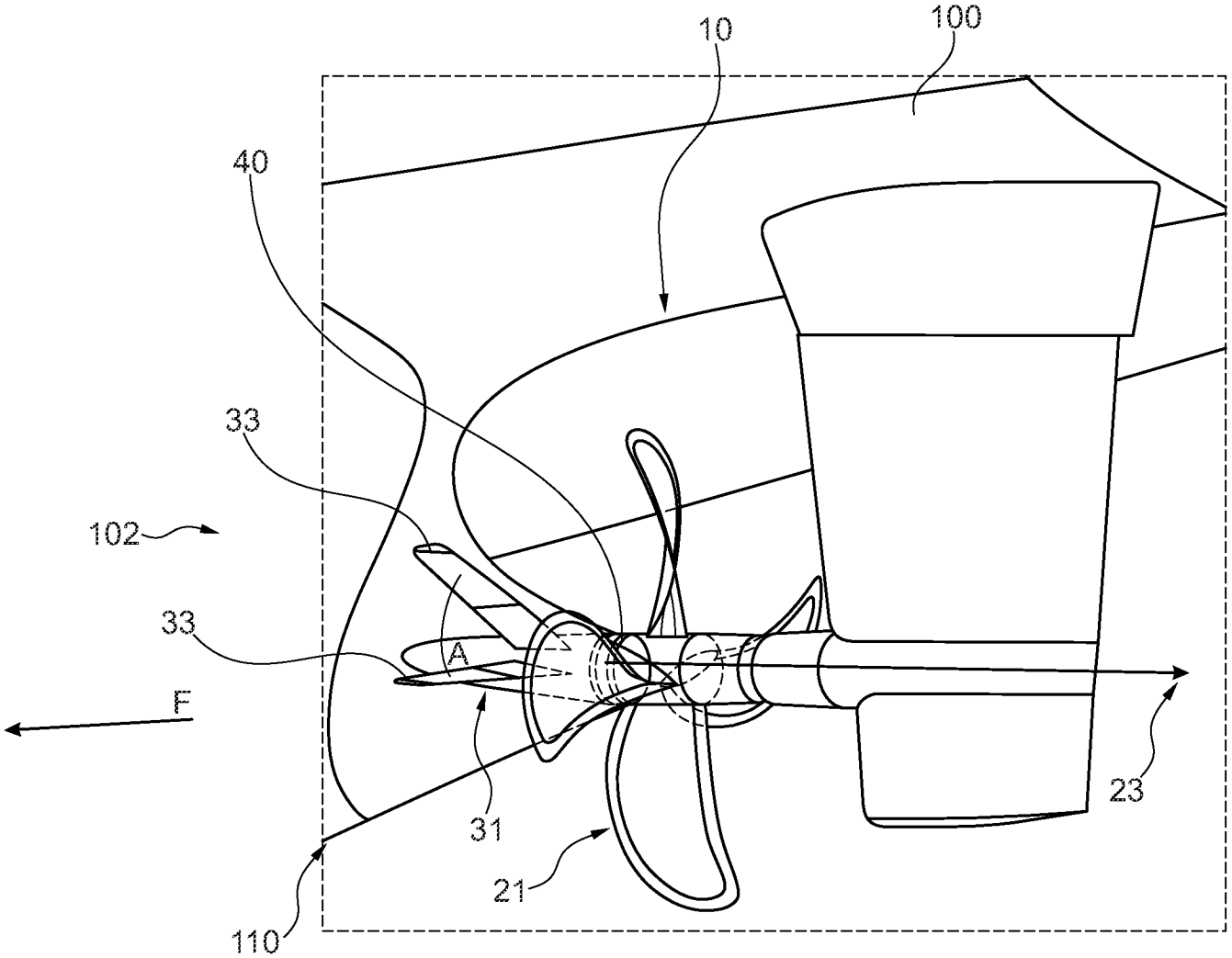
Figure 2B:
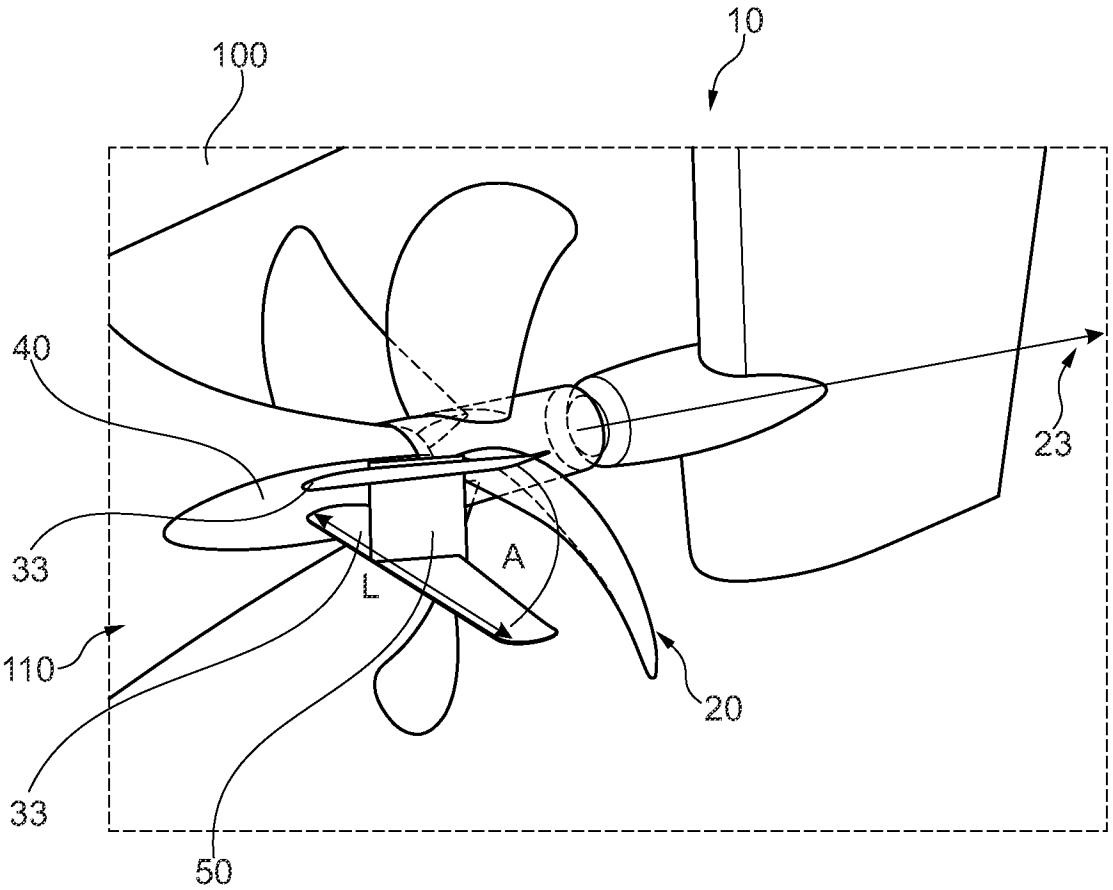
Figure 3:
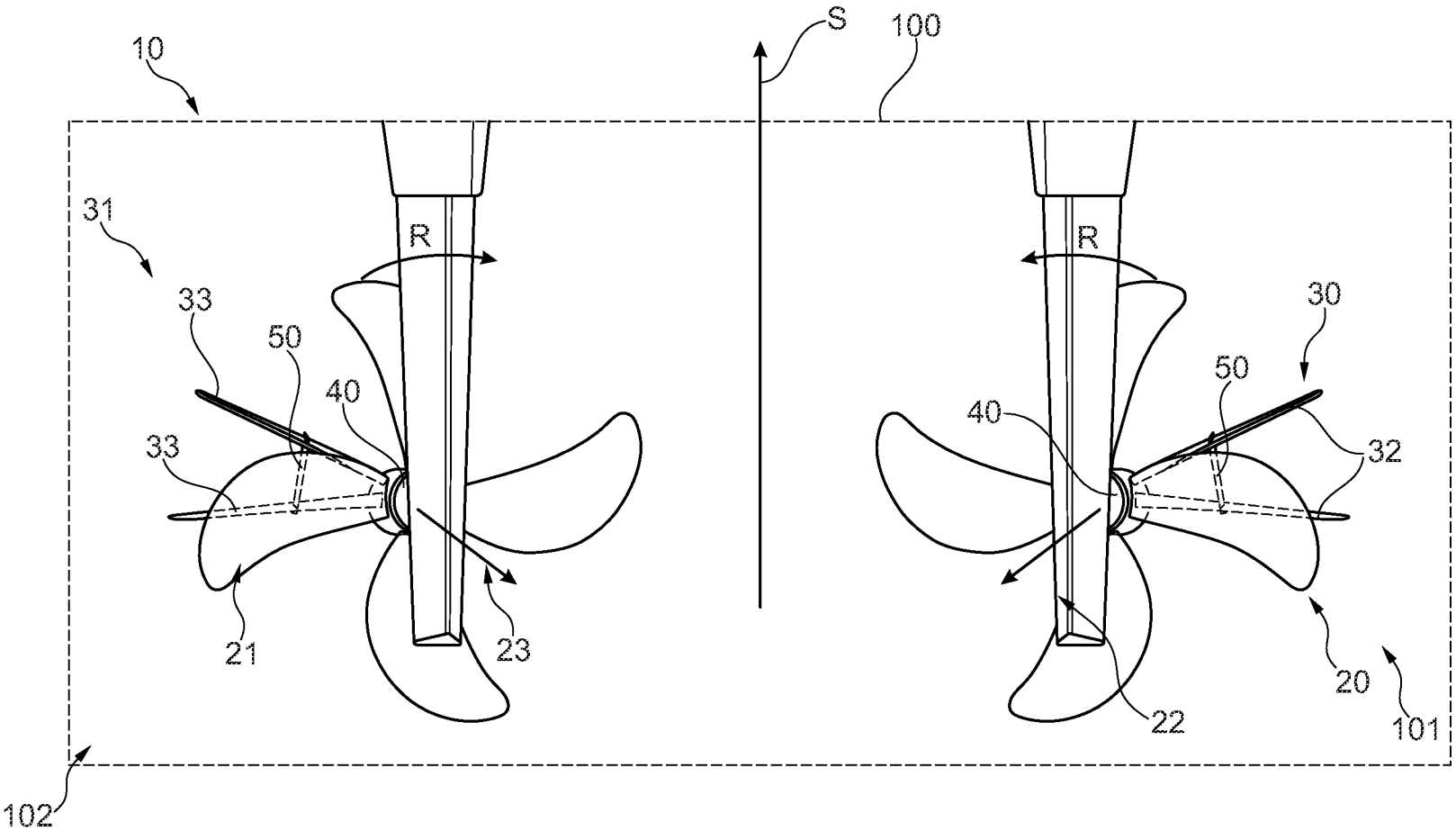

A plurality of exemplary embodiments of the invention are explained in more detail below on the basis of the drawings. The figures show:

FIG. 1 an exemplary simulation of the pre-swirl around propellers of a twin-screw ship, FIG. 2*a* a perspective illustration of an arrangement according to the invention in accordance with a first embodiment, FIG. 2*b* perspective illustrations of an arrangement according to the invention in accordance with a second embodiment, FIG. 3 rear view of the arrangement according to the invention in accordance with the second embodiment.

FIG. 1 shows an exemplary simulation of the pre-swirl in the area of propellers 20, 21 of a twin-screw ship 100, which are shown as an example in FIG. 2*a* and FIG. 3. The simulation shows a cross-sectional area of an inflow or in the direction of propellers 20, 21 of flowing water with a corresponding pre-swirl distribution. A pre-swirl around a first propeller axis 22 and around a second propeller axis 23 of a watercraft 100 designed as a twin-screw ship is shown.

An asymmetrical shape of a skeg 110 of the watercraft 100 creates areas with an increased pre-swirl 120 and areas with a reduced or non-existent pre-swirl 130. The corresponding arrow lengths illustrate an exemplary measure of pre-swirl, wherein light-shaded areas correspond to reduced pre-swirl and dark-shaded areas correspond to increased pre-swirl with respect to a propeller rotation direction.

The arrangement shown in FIG. 2*a* according to the invention 10 comprises guiding devices 30, 31, which are only arranged in areas 130 in which there is no pre-swirl or an unfavourable inflow.

FIG. 2*a* shows a perspective illustration of an arrangement according to the invention 10 in accordance with a first embodiment. Arrangement 10 serves to reduce the propulsion-power requirement of the twin-screw ship or watercraft 100. For the sake of clarity, only a second or left side of a stern section of watercraft 100 is shown. In FIG. 3, a stern view of watercraft 100 is shown, which illustrates both sides. FIG. 2*a* is described with reference to FIG. 3.

Arrangement 10 comprises a first propeller 20 and a second propeller 21. Furthermore, the arrangement 10 comprises a first guiding device 30 and a second guiding device 31.

When viewed in the forward direction F of the watercraft 100, the first guiding device 30 is arranged in front of the first propeller 20, and the second guiding device 31 is arranged in front of the second propeller 21.

The first propeller 20 and the second propeller 21 are attached to a first propeller shaft (not shown) and to a second propeller shaft (not shown), wherein the first propeller shaft defines the first propeller axis 22 and the second propeller shaft defines the second propeller axis 23.

In the illustrated exemplary embodiment, the first guiding device 30 and the second guiding device 31 each comprise two fins 32, 33, which extend radially from the propeller axes 22, 23. The fins 32, 33 of the first guiding device 30 and of the second guiding device 31 extend outwardly towards the sides of the watercraft 101, 102.

In particular, the first guiding device 30 extends to a first or right side of the watercraft 101, and the second guiding device 31 extends to a second or left side of the watercraft 102, respectively.

The two fins 32, 33 of the first and second guiding devices 30, 31 are at an angle A to each another. The two fins 32, 33 of the guiding devices 30, 31 are attached by way of example in the area of shaft bearings 40, in particular, to shells of stern tubes which are designed to support the first and second propeller shafts of the watercraft 100.

In der FIG. 2*b*, a perspective illustration of an arrangement according to the invention 10 in accordance with a second embodiment is shown. In particular, in FIG. 2*b* a side view of the watercraft 100 is shown analogous to FIG. 2*a*. In contrast to the embodiment that has already been described, the arrangement 10 comprises a connecting bar 50 radially centred between the fins 32, 33.

The fins 32, 33 have a length L, which corresponds to 100% of a propeller radius of the propellers 20, 21.

The two radially protruding fins 32, 33 comprise a connecting bar 50 arranged approximately radially in the centre. The connecting bar 50 can structurally reinforce the fins 32, 33. In particular, the fins 32, 33 are mechanically connected to each other by the connecting bar 50.

In FIG. 3, a stern view of watercraft 100. is shown. Thereby, the entire arrangement 10 is illustrated. The first and second guiding devices 30, 31 extend in the direction of the first and second sides of the watercraft respectively, 101, 102 starting from the shells of the stern tubes and shaft bearings 40, respectively. The direction of rotation of the two propellers is indicated by the two arrows R, which are arranged inwardly at an upper point of rotation, i.e., at a 12:00 o'clock position.

In the case of propellers 20, 21 rotating inwardly in the direction of arrows R, the two guiding devices 30, 31 are arranged on the outside or on the impinging sides of propellers 20, 21. Based on a view from the rear, the guiding devices 30, 31 are therefore located at 3:00 a.m. and at 9:00 a.m. In such a formation of arrangement 10, the guiding devices 30, 31 are preferably symmetrically arranged with respect to each other with respect to a vertical plane of symmetry S of the watercraft 100.

Such an arrangement of the guiding devices 30, 31 can be used to achieve particularly high energy savings or fuel reduction, particularly in the case of twin-screw ships.

Preferably, in addition to the guiding devices 30, 31, no other energy-saving devices comprising fins or nozzles on the watercraft are arranged in the area of propellers 20, 21 or even on rudders.

FIG. 3 also illustrates the symmetrical structure of arrangement 10 and guiding devices 30, 31. It can also be seen that the connecting piece or the connecting bar 50 is attached approximately in the middle of the fins 32, 33 when viewed along the length L of the fins 32, 33.

REFERENCE LIST

100 watercraft/twin-screw ship
101 first/right side of the watercraft
102 second/left side of the watercraft
110 skegs of the watercraft
120 areas with an increased pre-swirl
130 areas with a reduced pre-swirl
10 arrangement
20 first propeller
21 second propeller
22 first propeller axis
23 second propeller axis
30 first guiding device
31 second guiding device
32 fins of the first guiding device
33 fins of the second guiding device
40 shaft bearing
50 connecting bar
A angle between two fins
F forward direction of travel
L length of a fin
S vertical plane of symmetry of the watercraft
R direction of rotation

The invention claimed is:

1. Arrangement for reducing the propulsion-power requirement of a watercraft, comprising a first propeller and a second propeller and comprising a first guiding device and a second guiding device, wherein, in the forward direction of the watercraft, the first guiding device is arranged in front of the first propeller, and the second guiding device is arranged in front of the second propeller, wherein the first propeller and the second propeller are attached to a first propeller shaft and to a second propeller shaft, wherein the first propeller shaft defines a first propeller axis and the second propeller shaft defines a second propeller axis, wherein the first guiding device and the second guiding device each comprise at least one fin, which extends from the propeller axes, wherein the fin of the first guiding device and of the second guiding device extends outwardly towards the sides of the watercraft respectively, wherein the first guiding device and the second guiding device each comprise exactly two fins, wherein the two fins of the first and second guiding devices are each connected to each other by a connecting bar, wherein the connecting bar is arranged along a length of the fins considered between 30% and 70% of the length of the fins, and wherein the connecting bar extends exclusively between the two fins.

2. The arrangement according to claim 1, wherein the at least two fins of the first and second guiding devices are at an angle to each other, wherein the at least two fins of the guiding devices are attached in the area of shaft bearings or are attached to a watercraft hull.

3. The arrangement according to claim 1, wherein at least one fin of the guiding devices is set up to generate a pre-swirl when the first and second propellers are flown, wherein the pre-swirl is generated by the respective guiding device in an inflow region of the propellers which has no or a reduced pre-swirl generated by at least one asymmetrical skeg.

4. The arrangement according to claim 1, wherein the fin having a length, wherein the length of the fin corresponds to 65% to 110% of a propeller radius of the propellers.

5. The arrangement according to claim 4, wherein the connecting bar is shaped straight along a length or width of the connecting bar.

6. The arrangement according to claim 1, wherein the propellers are designed as counter-rotating propellers, wherein the first guiding device is arranged on an impinging side of the first propeller, and the second guiding device is arranged on an impinging side of the second propeller.

7. The arrangement according to claim 1, wherein the guiding devices are positioned essentially mirror-symmetrical to each other with respect to a vertical plane of symmetry of the watercraft.

8. The arrangement according to claim 1, wherein at least one fin has a constant profiling and/or position along its length.

9. Watercraft, comprising an arrangement for reducing the propulsion-power requirement of the watercraft, comprising a first propeller and a second propeller and comprising a first guiding device and a second guiding device, wherein, in the forward direction of the watercraft, the first guiding device is arranged in front of the first propeller, and the second guiding device is arranged in front of the second propeller, wherein the first propeller and the second propeller are attached to a first propeller shaft and to a second propeller shaft, wherein the first propeller shaft defines a first propeller axis and the second propeller shaft defines a second propeller axis, wherein the first guiding device and the second guiding device each comprise at least one fin, which extends from the propeller axes, wherein the fin of the first guiding device and of the second guiding device extends outwardly towards the sides of the watercraft respectively, wherein the first guiding device and the second guiding device each comprise exactly two fins, wherein the two fins of the first and second guiding devices are each connected to each other by a connecting bar, wherein the connecting bar is arranged along a length of the fins considered between 30% and 70% of the length of the fins, and wherein the connecting bar extends exclusively between the two fins.

10. Arrangement according to claim 1, wherein the connecting bar is shaped curved along a length or width of the connecting bar.

11. Arrangement according to claim 1, wherein at least one fin has a changing profiling or position along its length.

* * * * *